US007950659B2

(12) United States Patent
Matsushima

(10) Patent No.: US 7,950,659 B2
(45) Date of Patent: May 31, 2011

(54) SHEET CONVEYING DEVICE FOR IMAGE FORMING APPARATUS

(75) Inventor: Toshihiro Matsushima, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 77 days.

(21) Appl. No.: 12/363,331

(22) Filed: Jan. 30, 2009

(65) Prior Publication Data

US 2009/0194939 A1 Aug. 6, 2009

Related U.S. Application Data

(60) Provisional application No. 61/026,094, filed on Feb. 4, 2008.

(51) Int. Cl.
*B65H 5/00* (2006.01)
*B65H 5/02* (2006.01)

(52) U.S. Cl. ..... 271/264; 271/273

(58) Field of Classification Search ..... 271/264, 271/273

See application file for complete search history.

(56) References Cited

U.S. PATENT DOCUMENTS

| | | | | |
|---|---|---|---|---|
| 3,218,064 | A * | 11/1965 | Davidson, Jr. et al. | 271/273 |
| 4,124,204 | A * | 11/1978 | VanBuskirk | 271/287 |
| 4,570,923 | A * | 2/1986 | Hooper et al. | 271/275 |
| 6,145,828 | A * | 11/2000 | Arai | 271/3.03 |
| 6,578,845 | B2 * | 6/2003 | Chen | 271/273 |
| 6,736,395 | B2 * | 5/2004 | Frey et al. | 271/273 |

FOREIGN PATENT DOCUMENTS

| | | |
|---|---|---|
| JP | H10-212049 | 8/1998 |
| JP | 2005-82337 | 3/2005 |
| JP | 2007-39250 | 2/2007 |

* cited by examiner

*Primary Examiner* — David H Bollinger

(74) *Attorney, Agent, or Firm* — Patterson & Sheridan, LLP

(57) ABSTRACT

In an embodiment of the present invention, a plate is laid over sides of a second guide and a first guide that pivots relative to the second guide. The plate pivots with a first pin on the side of the second guide as a fulcrum. A second pin on the side of the first guide is inserted through a slit of the plate. The plate is pivoted by pivoting of the first guide in an opening direction. The second pin is fit in a stop slit provided in the slit to maintain the first guide in an open state. The first guide is pivoted in a closing direction to remove the second pin from the stop slit and close the first guide.

8 Claims, 8 Drawing Sheets

SHEET CONVEYING DEVICE FOR IMAGE FORMING APPARATUS

CROSS-REFERENCE TO RELATED APPLICATION

This application is based upon and claims the benefit of priority from Provisional U.S. Application 61/026,094 filed on Feb. 4, 2008, the entire contents of which are incorporated herein by reference.

TECHNICAL FIELD

The present invention relates to a sheet conveying device for an image forming apparatus that takes into account workability during maintenance in a copying machine, a multifunction peripheral, or the like.

BACKGROUND

There is an image forming apparatus in which a user performs, when a jam occurs in a sheet conveying device, jam removal process in a state in which a part of the sheet conveying device is drawn out halfway to, for example, a front side of an apparatus main body. The user pivots an upper guide of the sheet conveying device upward to open a sheet conveying path and perform the jam removal process. In the past, in the jam removal process, the user supports the upper guide with one hand and removes a sheet with the other free hand.

However, in the apparatus in the past in which the user performs the jam removal process while supporting the upper guide with a hand, if it is difficult to remove the sheet with one hand, workability for the jam removal process is likely to be poor. If the user releases the upper guide by mistake during the jam removal process, there is a risk that the user has his or her finger got caught in the upper guide. When an upper guide having a pivotal fulcrum on a rear side of the apparatus main body is used, if the user pushes the sheet conveying device to toward the apparatus main body side by mistake during the jam removal process, there is a risk that the upper guide closes and the user has got his or her finger got caught in the-upper guide.

There is a demand for a sheet conveying device for an image forming apparatus that can improve workability of the jam removal process and realize safety during the jam removal process when the user draws out the sheet conveying device to the front side and pivots the upper guide to perform the jam removal process.

SUMMARY

According to an aspect of the present invention, while a space is not required and operation is easy, workability of jam removal process is improved and safety during the jam removal process is realized.

According to the aspect, there is provided a sheet conveying device for an image forming apparatus including: a first conveyance guide member that conveys an output medium and moves relative to an apparatus main body; a second conveyance guide member that causes the output medium to pass between the first conveyance guide member and the second conveyance guide member and opens and closes relative to the first conveyance guide member; and a stopper member that is laid over the first conveyance guide member and the second conveyance guide member and maintains the second conveyance guide member in an open state relative to the first conveyance guide member.

DETAILED DESCRIPTION

An embodiment of the present invention is explained below.

Figure 1:
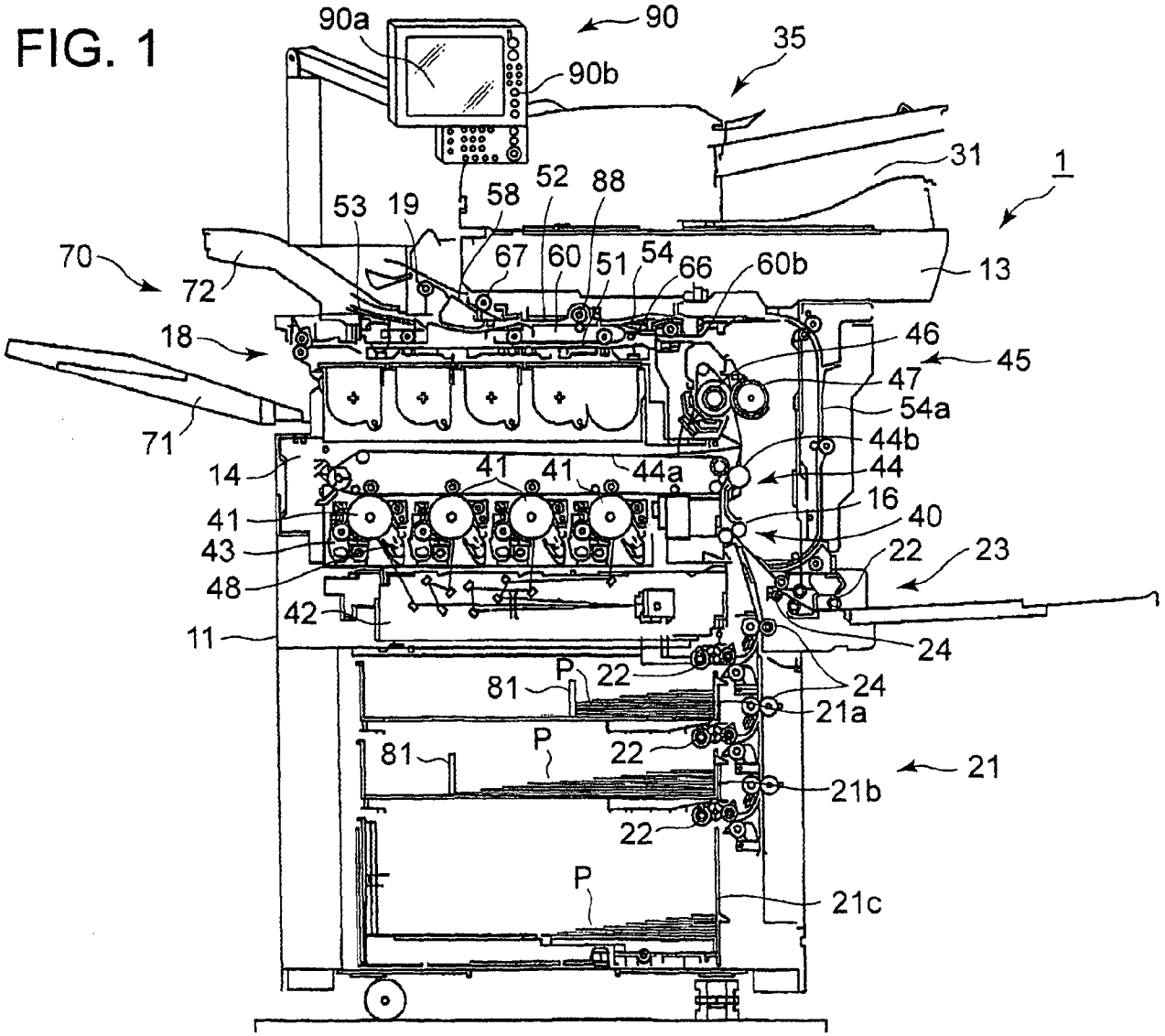
FIG. 1 is a schematic diagram of a copying machine according to an embodiment.

FIG. 1 is a schematic diagram of a copying machine I as an image forming apparatus according to the embodiment. The copying machine 1 includes a scanner unit 13 that scans an image, a printer unit 14 as an image forming unit, a paper feeding unit 21 that feeds sheets P as output media, and a paper discharging unit 70 including a first tray 71 and a second tray 72 for accumulating the sheets P discharged from the printer unit 14. A manual paper feeding unit 23 is provided on a side of a housing 11 as an apparatus main body configuring an outer casing of the copying machine 1. A conveying path 40 for the sheets P is provided in a route leading from the paper feeding unit 21 or the manual paper feeding unit 23 to the paper discharging unit 70 through the printer unit 14 of the copying machine 1. A control panel 90 is provided above the housing 11.

The scanner unit 13 scans an object having image information (hereinafter referred to as original document) fed from an auto document feeder (ADF) 35 and capture the image information as image data. After the scanner unit 13 finishes scanning the image information, the ADF 35 discharges the original document to an original discharging unit 31.

The printer unit 14 forms, on the sheet P, an image corresponding to inputted image information or the image information scanned by the scanner unit 13. The printer unit 14 includes photoconductive drums 41, charging devices 48 that uniformly charge the photoconductive drums 41, an exposing device 42 that forms electrostatic latent images on the photoconductive drums 41, developing devices 43 that develop the electrostatic latent images formed on the photoconductive drums 41, a transfer device 44 that transfers toner images developed on the photoconductive drums 41 onto the sheets P of arbitrary sizes, and a fixing device 45 that fixes the toner images on the sheets P having the toner images transferred thereon by the transfer device 44. The transfer device 44 includes a transfer belt 44*a* and a secondary transfer roller 44*b*. The fixing device 45 includes a fixing roller 46 and a press roller 47.

The paper feeding unit 21 includes an upper paper feeding cassette 21*a*, a lower paper feeding cassette 21*b*, and a large capacity cassette 21*c*. The conveying path 40 includes conveying rollers 24 and registration rollers 16 for feeding the sheet P taken out from the paper feeding unit 21 or the manual paper feeding unit 23 by a pickup roller 22 to the transfer device 44. The conveying path 40 conveys the sheet P having the fixed toner images to an inlet 60*b* of the paper discharging unit 70 through the transfer device 44 and the fixing device 45.

Figure 2:
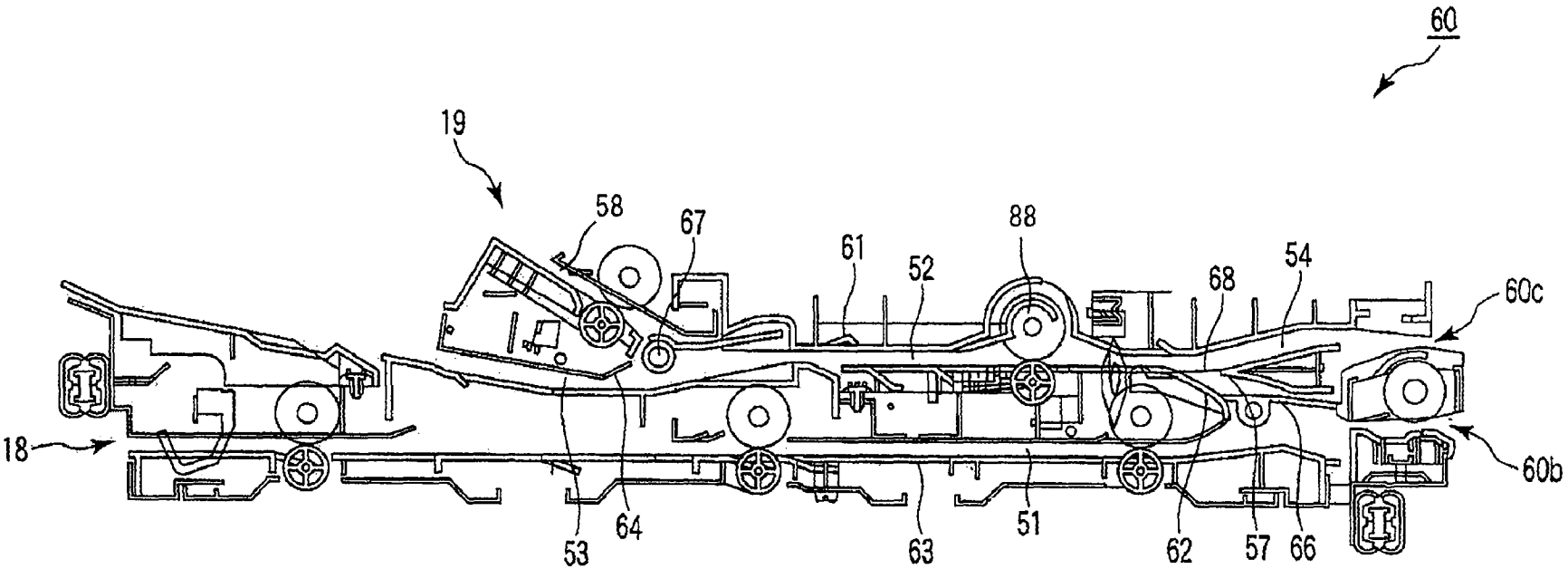
FIG. 2 is a schematic diagram of a paper discharging and conveying unit according to the embodiment.

The paper discharging unit 70 includes a paper discharging and conveying unit 60 that discharges the sheet P to the first tray 71 or the second tray 72 or reverses the sheet P. As shown in FIG. 2, the paper discharging and conveying unit 60 includes a first conveying path 51 and a second conveying path 52. A first gate 66 divides the first conveying path 51 on a lower side and the second conveying path 52 on an upper side. The first conveying path 51 reaches the first tray 71 through a first paper discharge port 18. The second conveying path 52 includes a fifth conveying path 58 on an upper side and a third conveying path 53 on a lower side. A second gate 67 divides the fifth conveying path 58 and the third conveying path 53.

The fifth conveying path 58 reaches the second tray 72 through a second paper discharge port 19. The third conveying path 53 is a reversing and retracting path for the sheet P. The paper discharging unit 70 includes, in the third conveying path 53, a reversing and conveying roller 88 for reversely conveying the sheet P. The paper discharging unit 70 includes a reversing film 68 and a third gate 57 for leading the sheet P to be reversed to a fourth conveying path 54. The reversing film 68 closes the first conveying path 51 below the reversing film 68 and prevents the sheet P from returning to the first conveying path 51 side. When a trailing end of the sheet P conveyed to the third conveying path 53 passes the first gate 66, the reversing and conveying roller 88 rotates in the opposite direction. A conveying direction of the sheet P is changed by the reverse rotation of the reversing and conveying roller 88. The sheet P is led to an inlet 60*c* of a circulating path 54*a* through the reversing film 68 and the third gate 57 and reversely conveyed in the direction of the circulating path 54*a*. The circulating path 54*a* feeds the sheet P to the transfer device 44 again.

The paper discharging and conveying unit 60 includes first to fourth guides 61 to 64. The first guide 61 (an upper guide 61) as a second conveyance guide member is provided in an upper part of the paper discharging and conveying unit 60 and configures the second conveying path 52. The second guide 62 (an intermediate guide 62) as a first conveyance guide member is provided in the center of the paper discharging and conveying unit 60 and sections the first conveying path 51 and the second conveying path 52. The third guide 63 (a lower guide 63) is provided below the second guide 62 and configures the first conveying path 51. The fourth guide 64 sections the third conveying path 53 and the fifth conveying path 58.

Figure 3:
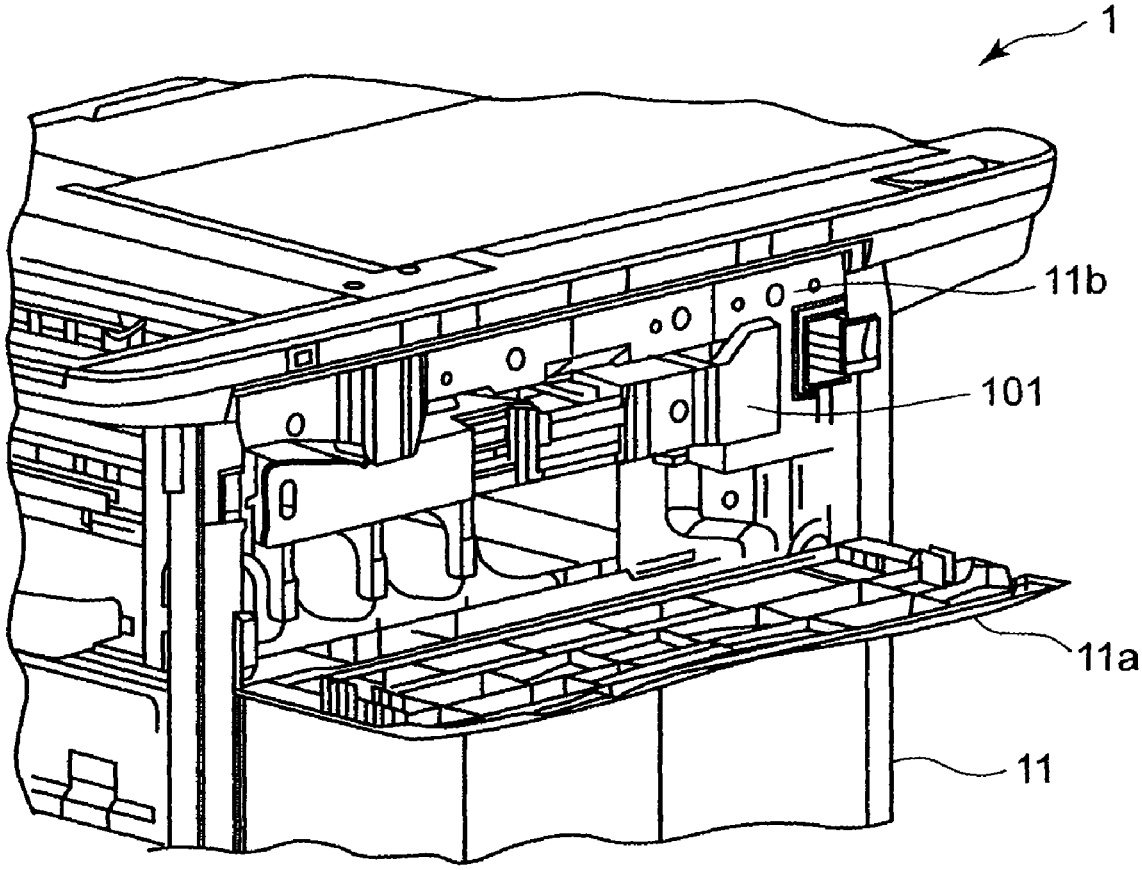
FIG. 3 is a partial perspective view of a state in which a front cover of the copying machine is opened according to the embodiment.
Figure 4:
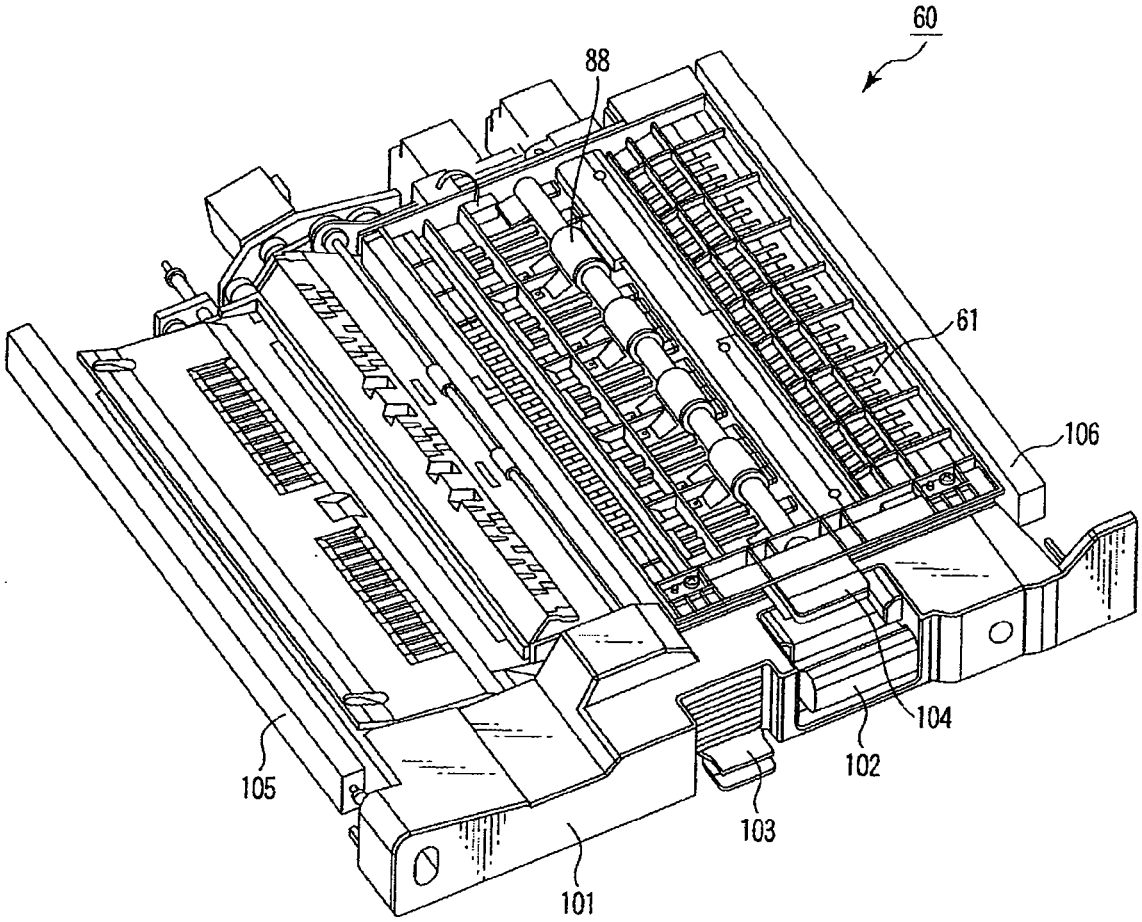
FIG. 4 is a schematic perspective view of the paper discharging and conveying unit according to the embodiment.

As shown in FIGS. 3 and 4, the paper discharging and conveying unit 60 is configured as a unit. A user opens a front cover 11*a* of the housing 11 of the copying machine 11, draws out a unit cover 101 to a front side, and integrally draws out the paper discharging and conveying unit 60 from the housing 11. The unit cover 101 includes a draw-out operation handle 102. The paper discharging and conveying unit 60 is unlocked by pulling the draw-out operation handle 102 to the front side to allow the user to draw out the paper discharging and conveying unit 60. The paper discharging and conveying unit 60 is drawn out from the housing 11 to the front side along slide rails 105 and 106 at both left and right ends.

Figure 5:
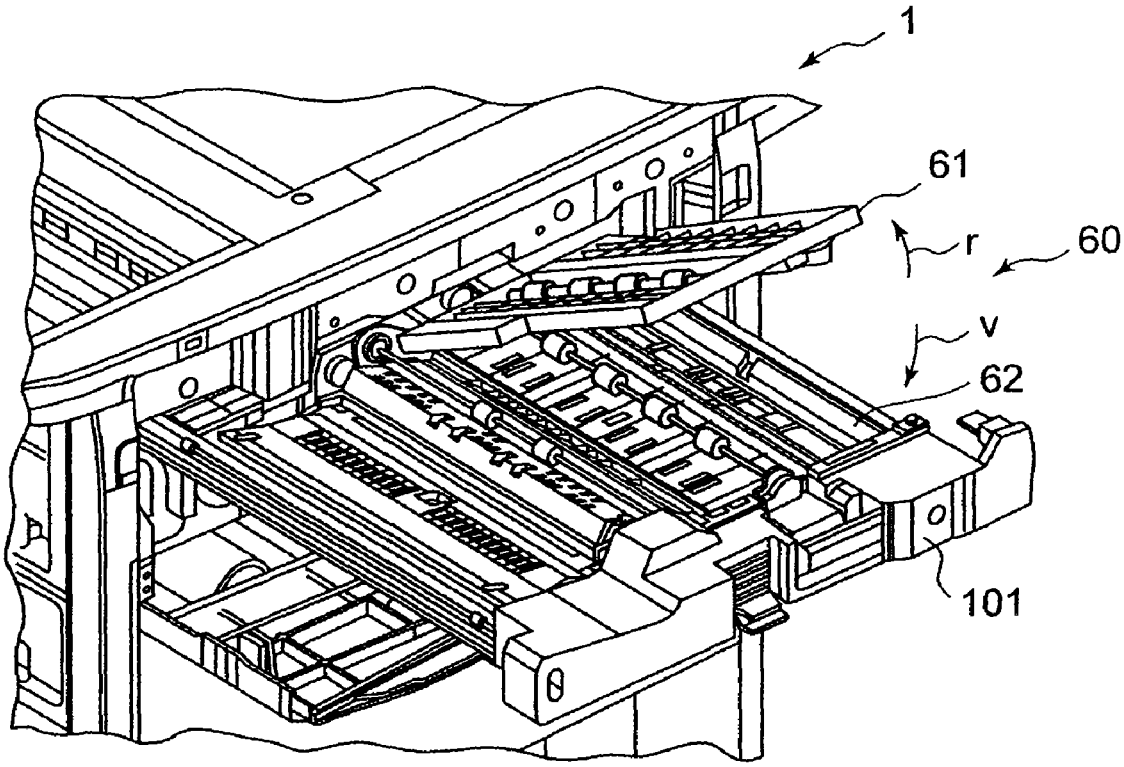
FIG. 5 is a schematic perspective view of a state in which the paper discharging and conveying unit is drawn out from an apparatus main body to pivot a first guide according to the embodiment.
Figure 6:
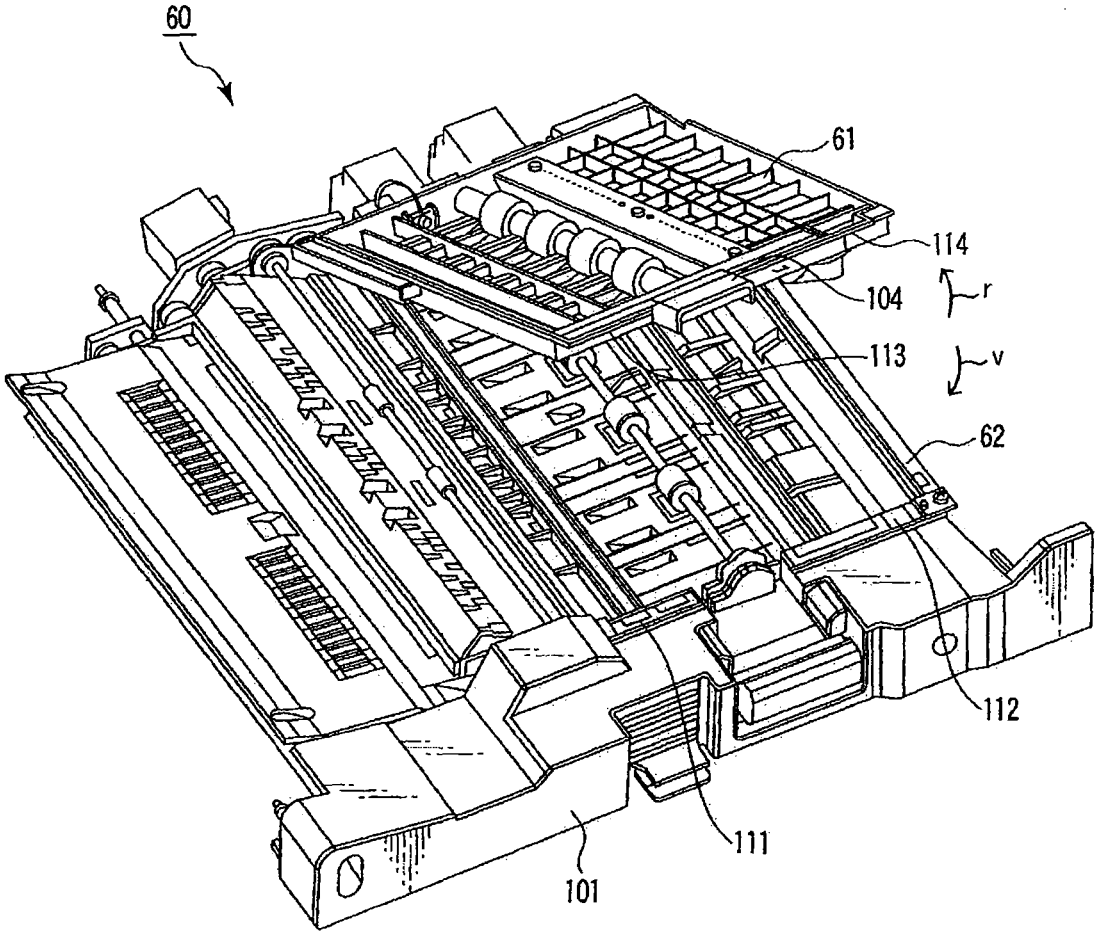
FIG. 6 is a schematic perspective view of pivoting of a first guide of the paper discharging and conveying unit according to the embodiment.
Figure 7:
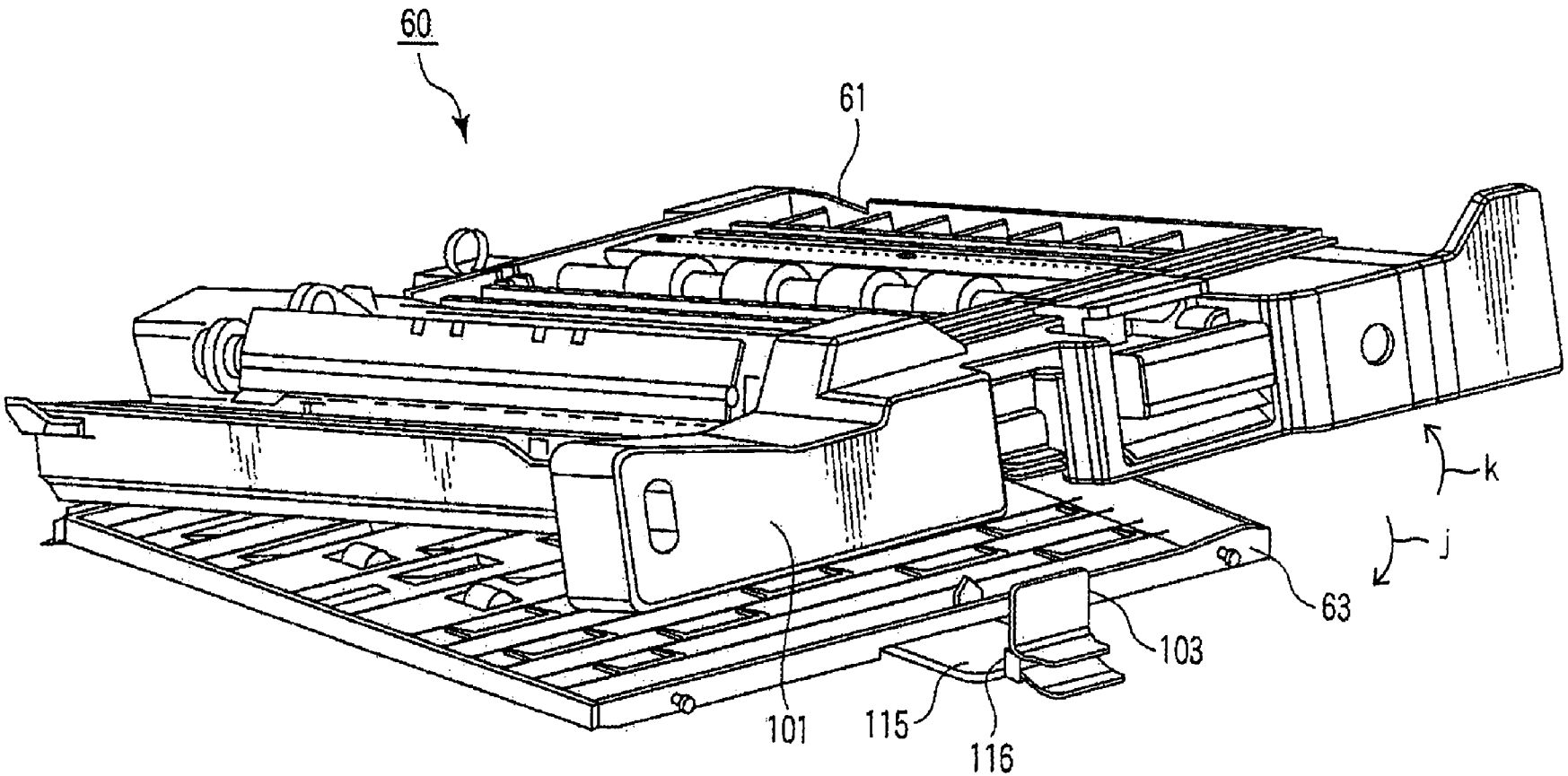
FIG. 7 is a schematic perspective view of pivoting of a third guide of the paper discharging and conveying unit according to the embodiment.

The first conveying path 51 and the second conveying path 52 can be opened in a state in which the paper discharging and conveying unit 60 is drawn out. As shown in FIGS. 5 and 6, the first guide 61 pivots relative to the second guide 62 with a rear side of the paper discharging and conveying unit 60 as a fulcrum. The user pivots the first guide 61 by operating a first cover handle 104. As shown in FIG. 7, the third guide 63 pivots relative to the second guide 62 with a rear side of the paper discharging and conveying unit 60 as a fulcrum. The user pivots the third guide 63 by operating a lock lever 103. The lock lever 103 is a member for locking open and close of the third guide 63.

Figure 8:
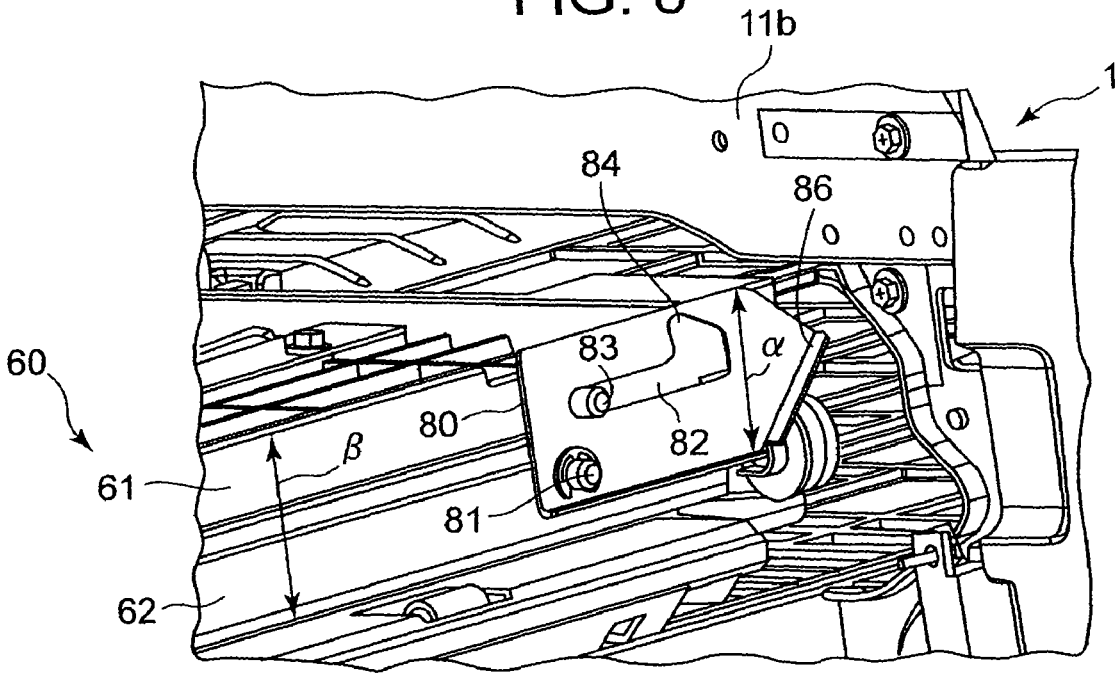
FIG. 8 is a schematic perspective view of a plate in a state in which the first guide is closed according to the embodiment.

As shown in FIG. 8, the paper discharging and conveying unit 60 includes a plate 80 as a stopper member and a plate member on a side thereof. One side of the plate 80 is attached to a first pin 81 as a fastening portion formed on a side of the second guide 62. The plate 80 pivots at the first pin 81 as a fulcrum. The plate 80 has a slit 82. A second pin 83 as a projecting member formed on a side of the first guide 61 is inserted through the slit 82. The plate 80 is laid over the second guide 62 and the first guide 61. The slit 82 includes a stop slit 84 that is a stay portion for staying the second pin 83 and in which the second pin 83 is fit.

The other side of the plate 80 includes a stop portion 86 located at height where the stop portion 86 comes into contact with an inner frame 11*b* of the housing 11 when the first guide 61 is pivoted to fit the second pin 83 in the stop slit 84. The stop portion 86 comes into contact with the inner frame 11*b* to thereby prevent the paper discharging and conveying unit 60 drawn out from the housing 11 from being pushed into the housing 11. The stop portion 86 is formed by bending a part of the other side of the plate 80. The width $\alpha$ of the plate 80 is smaller than a total $\beta$ of the widths of the sides of the first guide 61 and the second guide 62 at the time when the first guide 61 is closed. When the paper discharging and conveying unit 60 is inserted into the housing 11, the plate 80 is fitted along the sides of the first guide 61 and the second guide 62 and contained in a range of the widths of the sides of the first guide 61 and the second guide 62.

The control panel 90 includes a display unit 90*a* and a keyboard 90*b*. The control panel 90 has an input function for inputting conditions for image formation by the copying machine 1, start of the image formation, start of image scanning by the scanner unit 13, and the like. The control panel 90 has a display function and the like for performing display of a confirmation screen for inputted information and the like and display of a down state and the like of the copying machine 1.

When the user instructs the copying machine 1 to form an image on the sheet P, the charging device 48 charges the photoconductive drum 41. The exposing device 42 outputs image lights (exposure lights) corresponding to image data that should be formed as an image on the charged photoconductive drums 41. The exposing device 42 irradiates the exposure lights on the photoconductive drum 41 to form electrostatic latent images corresponding to the exposure lights thereon. The electrostatic latent image formed on the photoconductive drum 41 is developed with a toner by the developing device 43 and visualized. Toner images obtained by visualizing the electrostatic latent images on the photoconductive drums 41 are transferred onto the sheet P by the transfer device 44.

The sheet P is fed from the paper feeding unit 21 or the manual paper feeding unit 23 and conveyed through the conveying path 40 and reaches the transfer device 44. The toner image transferred onto the sheet P is fixed on the sheet P by the fixing device 45. The sheet P having the toner image fixed thereon is conveyed to the paper discharging and conveying unit 60. The sheet P is discharged to the first tray 71 or the second tray 72 by the paper discharging and conveying unit 60 or conveyed to the transfer device 44 again through the circulating path 54*a*.

While the designated image formation is carried out, for example, if a jam of the sheet P occurs in the paper discharging and conveying unit 60, the copying machine 1 displays, on the display panel 90*a*, the occurrence of the jam in the paper discharging and conveying unit 60 and stops the image forming operation. For the jam removal process, the user opens the front cover 11*a*, pulls the draw-out operation handle 102 of the unit cover 101, and draws out the paper discharging and conveying unit 60 to the front side.

If the jam occurs in the first conveying path 51, the user unlocks the third guide 63 with the lock lever 103 and pivots the third guide 63 in an arrow "j" direction as shown in FIG. 7. The user opens the first conveying path 51 to remove the jammed sheet P. When the jam removal process is finished, the user pivots the third guide 63 in an arrow "k" direction and locks the third guide 63 in a closed state with the lock lever 103.

Figure 9:
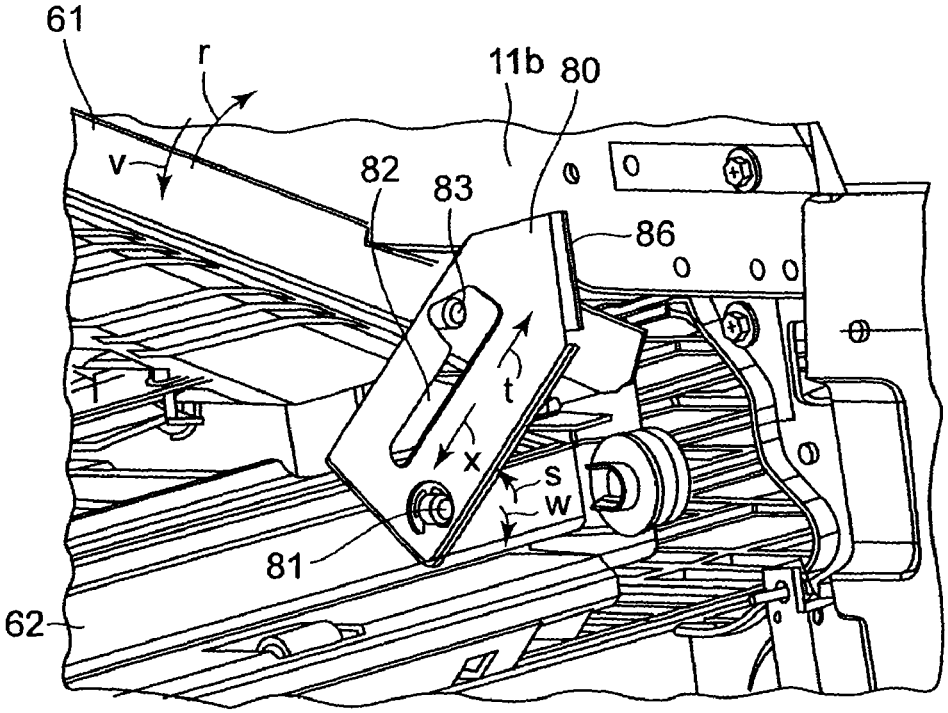
FIG. 9 is a schematic perspective view of the plate in a state in which the first guide is pivoted according to the-embodiment.

If the jam occurs in the second conveying path 52, as shown in FIGS. 6 and 9, the user lifts the first cover handle 104 to thereby pivot the first guide 61 with a rear side thereof as a fulcrum. The user opens the front side of the first guide 61 in an arrow "r" direction upward in the vertical direction. When the first guide 61 is opened in the arrow "r" direction, the second pin 83 is moved in the arrow "r" direction. The second pin 83 pivots, according to the movement in the arrow "r" direction, the plate 80 pivots in an arrow "s" direction via the slit 82 at the first pin 81 as a fulcrum. The second pin 83 slides in an arrow "t" direction in the slit 82 of the plate 80. When the pivot of the first guide 61 in the arrow "r" direction is progressed, the second pin 83 fits in the stop slit 84 at the end of the slit 82. Since the second pin 83 fits in the stop slit 84, the plate 80 maintains the first guide 61 with the front side opened. When the first guide 61 is maintained in the opened state, the stop portion 86 is located at height where the stop portion 86 comes into contact with the inner frame 11*b* of the housing 11.

The second pin 83 fits in the stop slit 84 and the first guide 61 is maintained in the opened state. Therefore, the user does not need to support the first guide 61 with one hand during the jam removal process. The user removes the jammed sheet P from the second conveying path 52 using both hands. Even if the user pushes the paper discharging and conveying unit 60 toward the housing 11 side by mistake during the jam removal process, when the stop portion 86 of the plate 80 comes into contact with the inner frame 11*b* of the housing 11, the paper discharging and conveying unit 60 cannot further slide toward the housing 11 side. There is no risk that the first guide 61 closes by mistake.

After finishing the processing for removing the jammed sheet P in the second conveying path 52, the user pivots the first guide 61 in an arrow "v" direction downward in the vertical direction to close the first guide 61. When the first guide 61 is closed, the second pin 83 moves in an arrow "v" direction and comes off from the stop slit 84. When the first guide 61 further pivots in the arrow "v" direction, the second pin 83 slides in an arrow "x" direction in the slit 82. As shown in FIG. 8, when the first guide 61 is completely closed, the plate 80 fits in the width β of the sides along the sides of the first guide 61 and the second guide 62 of the paper discharging and conveying unit 60. After closing the first guide 61, the user slides and pushes the paper discharging and conveying unit 60 inward into the housing 11 to lock the paper discharging and conveying unit 60 in the housing 11. The user closes the front cover 11*a* and finishes the jam removal process.

In this embodiment, in a state in which the first guide 61 is closed, the plate 80 fits in the width of the side of the paper discharging and conveying unit 60. The plate 80 does not require a large storage space when the plate 80 is stored. In opening the second conveying path 52, the user pivots the first guide 61 in an opening direction and fits the second pin 83 of the first guide 61 in the stop slit 84 of the plate 80. The first guide 61 is maintained in an open state without the user supporting the first guide 61 with a hand. After finishing the jam removal process, the user pivots the first guide 61 in a closing direction to remove the second pin 83 from the stop slit 84. Further, the user pivots the first guide 61 to close the first guide 61.

The user can maintain the first guide 61 in the open state by pivoting the first guide 61 in the opening direction. The user can release the open state of the first guide 61 by pivoting the first guide 61 in the open state in the closing direction. New operation for maintaining the first guide 61 in the open state during the jam removal process is unnecessary. The user can remove the sheet P from the second conveying path 52 with both hands. Therefore, operability during the jam removal process is improved. When the first guide 61 is maintained in the open state, the stop portion 86 is located at height where the stop portion 86 comes into contact with the inner frame 11*b*. Even if the user pushes the paper discharging and conveying unit 60 toward the direction of the housing 11 by mistake during the jam removal process, when the stop portion 86 comes into contact with the inner frame 11*b*, the paper discharging and conveying unit 60 does not further move in the direction of the housing 11. The risk that the first guide 61 closes by mistake and the user has his or her finger got caught in the first guide 61 is prevented and safety is improved.

The present invention is not limited to the embodiment and can be variously changed within the scope of the present invention. For example, the output medium passing between the first conveyance guide member and the second conveyance guide member may be either an output medium passing in a paper discharging direction or an output medium passing in a reversing direction. The stopper member does not have to come into contact with the apparatus main body as long as the first conveyance guide member can be surely maintained in the open state. In order to make the stay of the projecting member by the stay portion more firm, an elastic member may be provided in the stay portion to stay the projecting member with elastic force.

What is claimed is:

1. A sheet conveying device for an image forming apparatus comprising:

a first conveyance guide member that conveys an output medium and moves relative to an apparatus main body;

a second conveyance guide member that causes the output medium to pass between the first conveyance guide member and the second conveyance guide member and opens and closes relative to the first conveyance guide member; and a stopper member that is provided on the first conveyance guide member and the second conveyance guide member to maintain the second conveyance guide member in an open state relative to the first conveyance guide member and is disposed on sides of the first conveyance guide member and the second conveyance guide member when the second conveyance guide member is closed.

2. The device according to claim 1, wherein the stopper member is a plate member that is attached, on one side, to a fastening portion of the first conveyance guide member and pivots with the fastening portion as a fulcrum according to pivoting of the second conveyance guide member, and a width of the plate member is equal to or smaller than a total value of widths of sides of the first conveyance guide member and the second conveyance guide member at the time when the second conveyance guide member is closed.

3. A sheet conveying device for an image forming apparatus comprising:

a first conveyance guide member that conveys an output medium and moves relative to an apparatus main body;

a second conveyance guide member that comprises a projecting member on a side and causes the output medium to pass between the first conveyance guide member and the second conveyance guide member and opens and closes relative to the first conveyance guide member; and a plate member that comprises a slit which comprises a stay portion for staying the projecting member and is inserted the projecting member, and the plate member is attached, on one side, to a fastening portion of the first conveyance guide member and pivots with the fastening portion as a fulcrum according to pivoting of the second conveyance guide member, and when the projecting member is stayed in the stay portion, an other side of the plate member is present in a region where the other side comes into contact with the apparatus main body, and the plate member is provided on the first conveyance guide member and the second conveyance guide member to maintain the second conveyance guide member in an open state relative to the first conveyance guide member.

4. An image forming apparatus comprising:

an image forming unit;

an apparatus main body that holds the image forming unit;

a first conveyance guide member that conveys an output medium and moves relative to the apparatus main body;

a second conveyance guide member that causes the output medium to pass between the first conveyance guide member and the second conveyance guide member and opens and closes relative to the first conveyance guide member; and a stopper member that is provided on the first conveyance guide member and the second conveyance guide member to maintain the second conveyance guide member in an open state relative to the first conveyance guide member and is disposed on sides of the first conveyance guide member and the second conveyance guide member when the second conveyance guide member is closed.

5. The apparatus according to claim 4, further comprising, on a side opposed to the second conveyance guide member, a third conveyance guide member that pivots relative to the first conveyance guide member and causes the output medium to pass between the first conveyance guide member and the third conveyance guide member.

6. The apparatus according to claim 5, wherein the stopper member maintains the second conveyance guide member in the open state when the second conveyance guide member is pivoted upward in a vertical direction relative to the first conveyance guide member.

7. The apparatus according to claim 4, wherein the stopper member is a plate member that is attached, on one side, to a fastening portion of the first conveyance guide member and pivots with the fastening portion as a fulcrum according to pivoting of the second conveyance guide member, and a width of the plate member is equal to or smaller than a total value of widths of sides of the first conveyance guide member and the second conveyance guide member at the time when the second conveyance guide member is closed.

8. The apparatus according to claim 4, wherein the second conveyance guide member has a projecting member on a side, and the stopper member is a plate member that is attached, on one side, to a fastening portion of the first conveyance guide member and pivots with the fastening portion as a fulcrum according to pivoting of the second conveyance guide member, and the plate member has a slit through which the projecting member is inserted, and the slit has a stay portion for staving the projecting member, and when the projecting member is stayed in the stay portion, an other side of the plate member is present in a region where the other side comes into contact with the apparatus main body.

* * * * *